US006318037B1

(12) United States Patent
Hansen

(10) Patent No.: US 6,318,037 B1
(45) Date of Patent: Nov. 20, 2001

(54) WINDOW FRAME

(75) Inventor: Helge Hansen, Greve (DK)

(73) Assignee: Thermoform A/S, Greve (DK)

( * ) Notice: Subject to any disclaimer, the term of this patent is extended or adjusted under 35 U.S.C. 154(b) by 0 days.

(21) Appl. No.: 09/271,144

(22) Filed: Mar. 17, 1999

(30) Foreign Application Priority Data

Aug. 21, 1998 (DK) ..... BA 1998 00300

(51) Int. Cl.[7] ..... E06B 3/00

(52) U.S. Cl. ..... 52/208; 52/204.72; 52/204.54; 52/204.55

(58) Field of Search ..... 52/204.5, 204.53, 52/204.54, 204.55, 204.71, 204.72, 222, 208, DIG. 17, 656.2, 656.7, 656.4, 656.5; 403/297, 408.1

(56) References Cited

U.S. PATENT DOCUMENTS

| | | | | |
|---|---|---|---|---|
| 2,641,031 | * | 6/1953 | Ehret | 52/208 |
| 2,840,869 | * | 7/1958 | Fegan | 52/208 |
| 3,903,669 | | 9/1975 | Pease, Jr. et al. . | |
| 4,647,264 | * | 3/1987 | Pamer | 403/408.1 |
| 4,903,454 | * | 2/1990 | Rose | 52/766 |
| 5,106,225 | * | 4/1992 | Andre | 403/408.1 |
| 5,629,823 | * | 5/1997 | Mizuta | 403/297 |
| 5,636,484 | * | 6/1997 | DeBlock | 52/204.71 |
| 5,644,881 | | 7/1997 | Neilly . | |

FOREIGN PATENT DOCUMENTS

| | | | |
|---|---|---|---|
| 0574344 | | 12/1993 | (EP) . |
| 1041751 | | 10/1953 | (FR) . |
| 2711390 | | 4/1995 | (FR) . |
| 2 711 390 | * | 4/1995 | (FR) ..... E06F/3/58 |

* cited by examiner

*Primary Examiner*—Robert Canfield
(74) *Attorney, Agent, or Firm*—Miles & Stockbridge; Dennis P. Clarke

(57) ABSTRACT

A Window frame including two frame members (1, 2) adapted to mutual locking engagement, between which members a window pane (50) can be secured. One frame member (1) includes a tubular portion (5), into which a screw (3) may, be driven through the second frame member (2). The second frame member (2) further includes an engagement means in the form of a cavity (4), in which the tubular portion (5) may be inserted through an opening in the cavity. The tubular portion (5) is slit in such a manner that it expands for engagement with the engagement means.

14 Claims, 5 Drawing Sheets

WINDOW FRAME

BACKGROUND OF THE INVENTION

1. Field of the Invention

The present invention relates to a window frame comprising two frame members adapted to mutual locking engagement, between which members a window pane can be secured, one frame member comprising a tubular portion, into which a screw may be driven through the second frame member.

2. Description of the Related Art

Window frames of the type mentioned by way of introduction are known in which a window is retained between two frame members. These window frames are designed in such a manner that the two frame members constitute counterparts fitting into an aperture in a mounting surface such as a wall, a gate, a car body, etc., and to a certain extent, the frame members overlap the mounting surface. The two frame members are mounted from each side of the mounting surface, such that the members overlapping the mounting surface are arranged to clamp the surface, so that the window is secured in the mounting surface.

Such window frames may, for instance, be manufactured from a thermoplastic material by injection moulding or the like.

To obtain a locking engagement between the two frame members, one of the frame members may be provided with one or more tubular portions, whereas the second frame member may be provided with holes at places corresponding to the positioning of the tubular parts on the first-mentioned frame member.

By driving a screw through the holes and into the frame, the two frame members may be brought into locking engagement. The screw thus engages the tubular portion and pulls the two frame members together. During assembly, the screw cuts a thread which ensures a locking engagement.

Typically, when such frames are to be mounted, one out of three mounting situations presents itself. Namely, the primary mounting in a factory, the secondary mounting by a fitter at the place of installation or the tertiary mounting by the end user.

The primary mounting situation may, for instance, be mounting of a frame in a garage door in a factory. Mounting in a factory typically involves a large number of items, and the mounting process will as a consequence be automated.

The secondary mounting situation may be mounting of frames with window panes at the place of installation. This might, for instance, include postmounting of windows in an already existing, previously installed garage door, which has not previously been provided with windows. In such instances, a fitter has to cut openings first, or there may be a need to change to other types of windows and frames.

The tertiary mounting situation is the one made by the end user. In this case it may for instance be a question of replacing a single defective pane, in an already existing, previously mounted garage door. In such a case, the end user needs to be, able to dismount the frame without ruining it, insert a new pane and then remount the frame.

It is important that the mounting in the tertiary situation takes place without the use of special tools, because the typical end user is assumed to not possess special tools. Moreover, the end user cannot be assumed to possess any essential experience in, or knowledge of, dismounting (or mounting) window frames. It is important that the end user can intuitively dismount the window frames, such that, when trying to separate the frame members, the end user does not inadvertently ruin them.

The previously mentioned screw mounting step does meet the requirements of the secondary and tertiary mounting situations. The only tool required being a suitable screwdriver for screwing the screws in and out.

The requirement to install screws does, however, conflict with the primary mounting situation, where there is a need for the quickest possible mounting of the comparatively large number of screws necessary for holding the frame together. Screwing in of the screws one by one is, even when a robot is used, fairly time-consuming, and by simultaneous screwing in of several or all screws with several tools, the complexity of the required equipment increases, and erection or readjustment time therefore becomes time-consuming.

With a view to automatic, mounting, frames have admittedly already been developed, in which screwing is completely avoided, as self-locking members are pressed into one another. However, these frames do not meet the requirements of the second and tertiary mounting, due to the fact that either the frames cannot be disassembled without the frame members being ruined, or a separation can only be made by use of a special tool or by someone having a special knowledge of the construction of the locking mechanism.

SUMMARY OF THE INVENTION

It is therefore the object of the present invention to provide a window frame that is operative in above-mentioned mounting situations.

The object of the present invention is met by a window frame wherein the second frame member further comprises an engagement means in the form of a cavity in which the tubular portion may be inserted through an opening in the cavity. The tubular portion is slit in such a manner that it may expand for engagement with the engagement means.

In order to obtain the best possible locking by friction or by form, it is advantageous if the form and the cross section of the opening correspond to the cross section of the tubular part.

This locking becomes particularly advantageous if the step of driving the screw into the tubular part expands the tubular part to a form that is substantially complementary to the cavity.

In an embodiment of the invention, the cavity is undercut in the form of a truncated cone, preferably in such a way that the mathematical generating line of the truncated cone forms an acute angle, preferably approx. 1°, with the axis of rotation.

This makes it possible to injection mould the frame members in a double injection type injection moulding process.

In another embodiment of the invention, the cavity is undercut in the form of a frustum of a pyramid, preferably such that the edges of the frustum of the pyramid form an acute angle, preferably 1°, with an axis perpendicular to the base and extending through an imaginary pyramidal apex.

It is particularly advantageous if the screw may be driven into the tubular portion without rotation, as the screw at the primary automatic mounting may be pressed in simultaneously with the pressing in place of the two frame members.

To retain the screw in the frame during the automatic mounting, it is advantageous if the bottom of the cavity, which is positioned opposite the opening, is provided with a means for retaining the screw. This is accomplished simply by retaining the screw with a thin membrane.

For aesthetic and practical reasons each of the two frame members maybe provided with tubular portions or cavities, respectively. As a result, in connection with all three mounting types mentioned, work only has to be done from one side and therefore, the screws will be visible only from one side. For example, the screws will only be visible on the side of a garage door facing away from the street.

BRIEF DESCRIPTION OF THE DRAWINGS

The invention will be described in the following with reference to non-limiting examples and with reference to the drawings, in which.

DESCRIPTION OF THE PREFERRED EMBODIMENT

Figure 1:
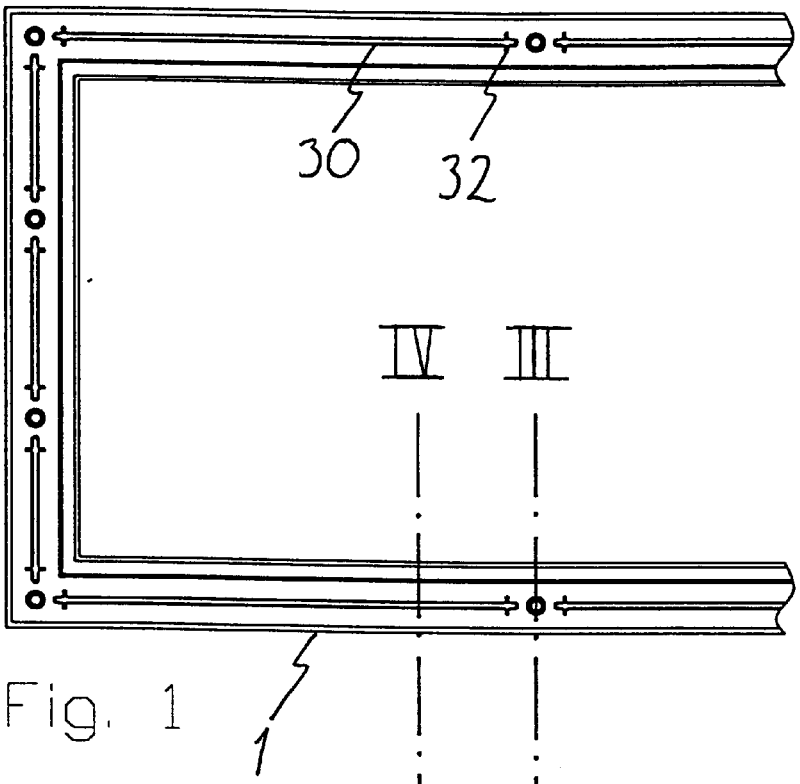
FIG. 1 is a sectional view of a first embodiment of a frame member comprising tubular portions.

In the following description, identical members in the various embodiments have identical reference numerals.

In FIG. 1, a sectional view is shown of a first frame member 1 according to the present invention. The first frame member is preferably injection moulded from a thermoplastic material by an injection moulding process with double ejection. The chosen material can, from a moulding technical point of view, be practically any thermoplastic material, but for reasons of use a plastic type having good weather resistance, including resistance towards TJV sunlight, will typically be chosen. Acrylic-styrene-acrylonitrile (ASA) will thus be preferred, said material having good weather resistance, but dyed acrylonitrile-butadienestyrene (ABS) or polyvinyl chloride (PVC) may for instance also be used.

Figure 2:
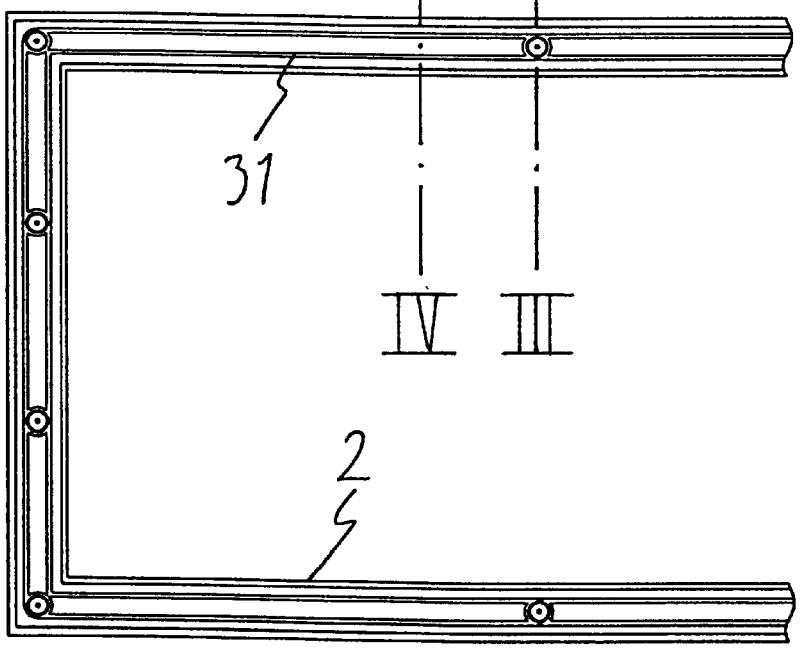
FIG. 2 is a sectional view of a first embodiment of a frame member comprising engagement means.
Figure 3:
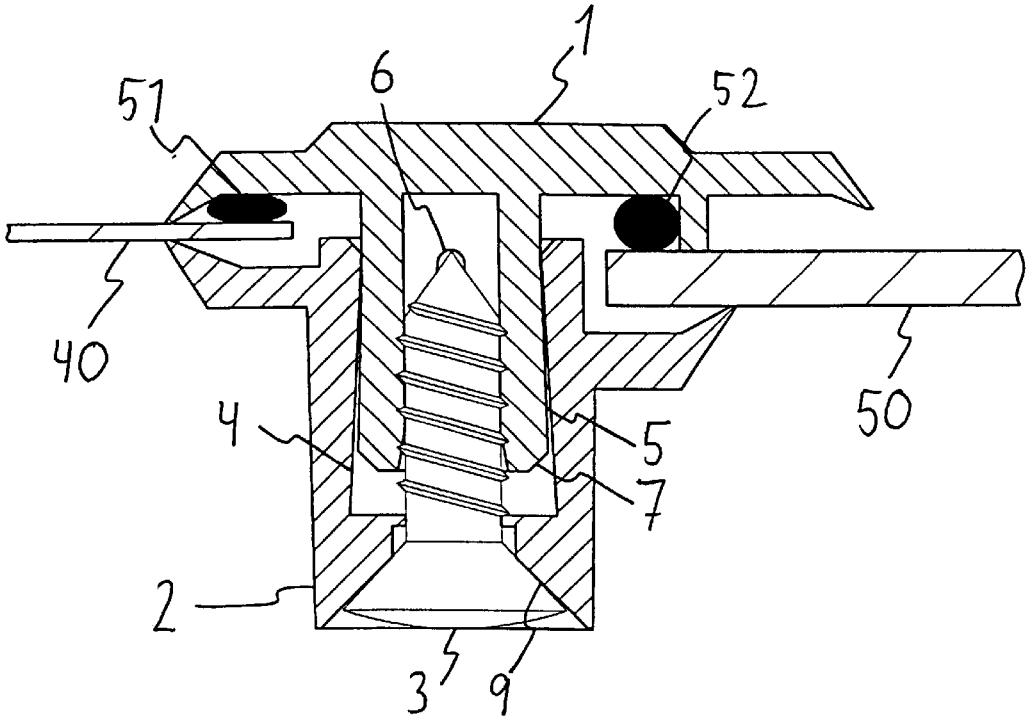
FIG. 3 shows in connection with two assembled frame members a, sectional view along the line III—III in FIGS. 1 and 2 through a tubular portion and an engagement means.
Figure 4:
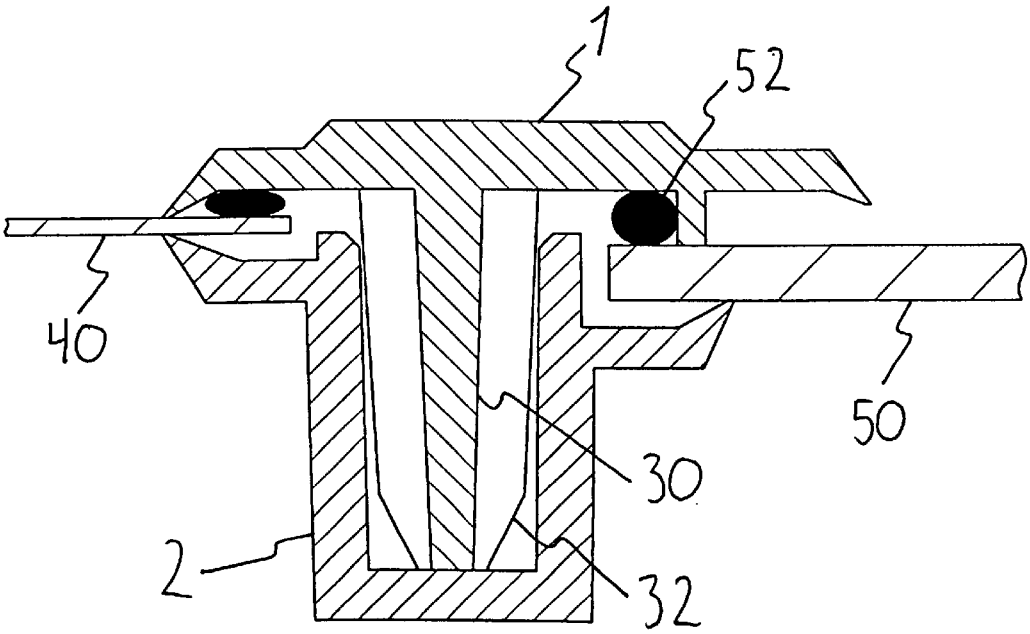
FIG. 4 shows in connection with two assembled frame members a sectional view along the line IV—IV in FIGS. 1 and 2 at a point away from the tubular portions and the engagement means.
Figure 5:
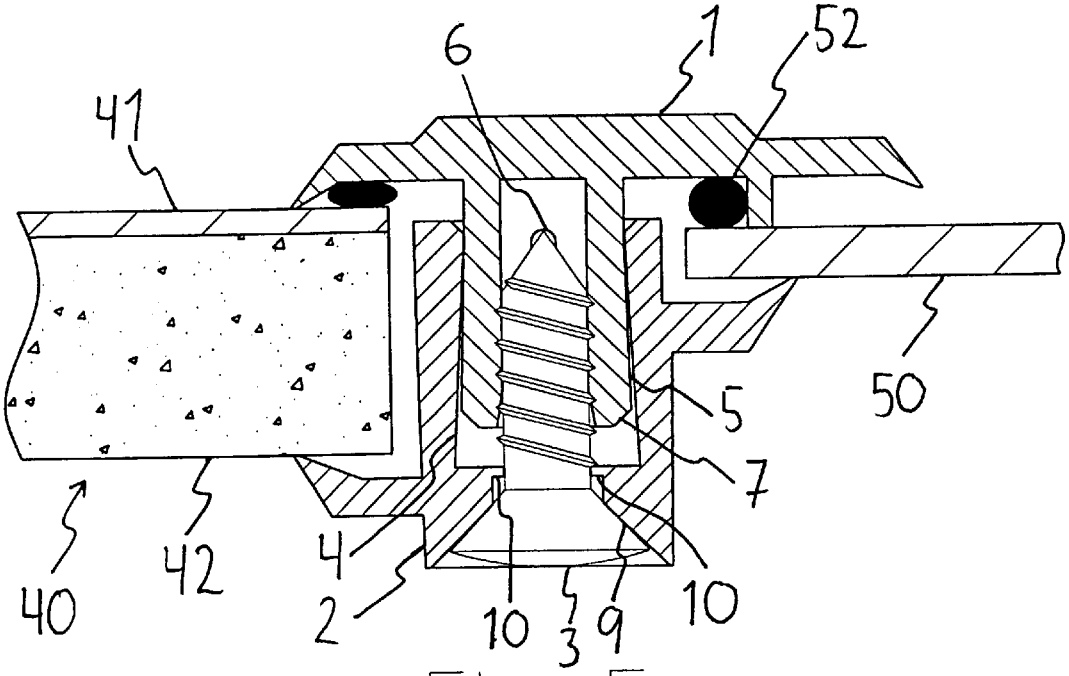
FIGS. 5 and 6 show sectional views corresponding to FIGS. 3 and 4, the frame member carrying the engagement means being, according to a second embodiment, adapted for mounting in a thicker mounting surface.
Figure 6:
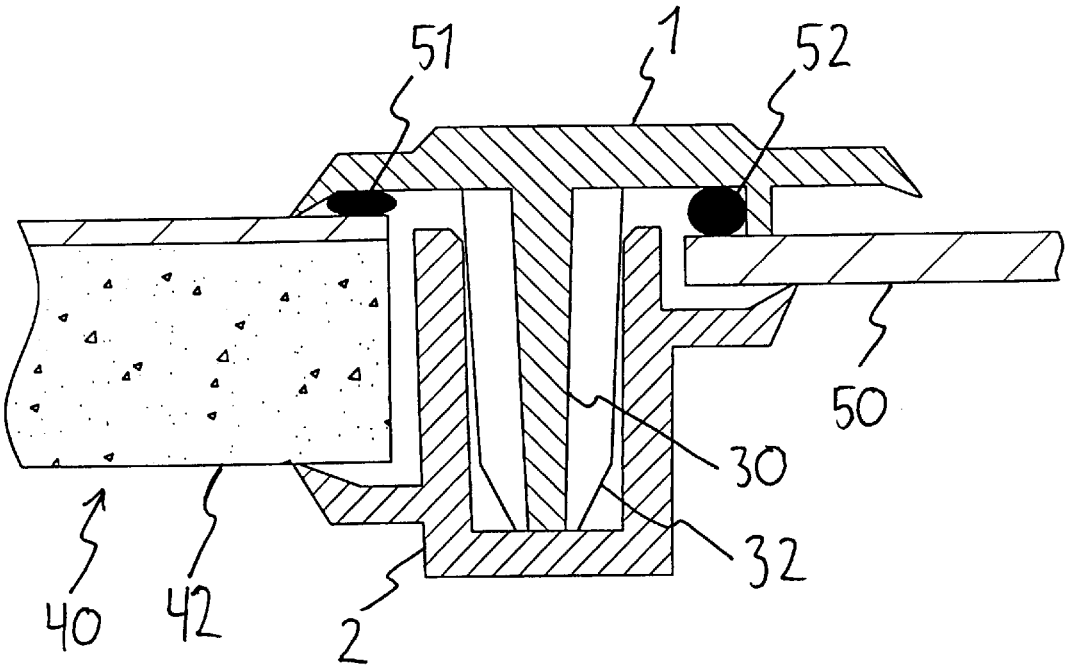
Figure 7:
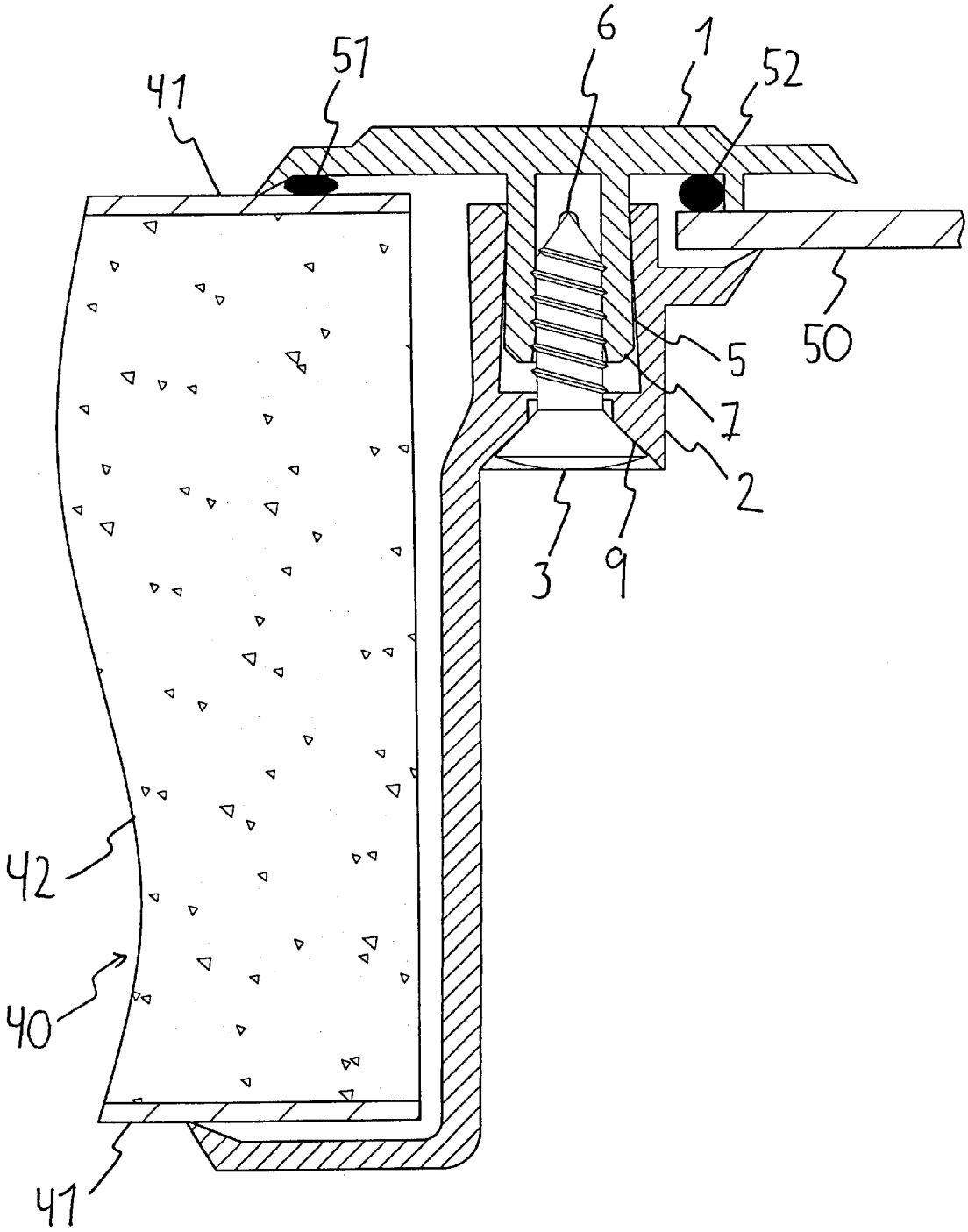
FIG. 7 shows a sectional view corresponding to FIGS. 3 and 4, the frame members being, according to a third embodiment, adapted for mounting in an even thicker mounting surface.

The first frame member 1 is provided with longitudinal raised members 30 which contribute to the rigidity of the frame and, prevent sink marks from the moulding process. These raised members 30 fit, when the frame members 1, 2 (FIGS. 1 and 2) have been assembled into recesses 31 in the second frame member 2. The raised members 30 may be provided with longitudinal ribs 32 contributing to the positioning of the frame members 1, 2 relative to each other during the mounting.

In FIGS. 3–7 sectional views are shown through different embodiments of the window frame comprising the two frame members 1, 2 in assembled, finished condition. In this condition the two frame members 1, 2 clamp a window pane 50 and a mounting surface 40. The window pane 50 may be a single-layer pane or a multi-layer pane, but is shown as a non-limiting example as a single-layer pane. The mounting surface 40 may be any of various designs. In the simplest embodiment (FIGS. 2 and 3) mounting surface 40 includes a thin plate of, for instance, metal. For certain purposes the mounting surface 40 consists of a thick laminate, for instance, plastic foam 42 of a given thickness, and one or more layers of a strong skin 41 configured to protect the plastic foam 42 and give the mounting surface a suitable aesthetic appearance. The skin 41 may, for instance, be a non-foamed plastic layer or a metal plate. Such laminated mounting surfaces are, for instance, used if noise reduction or heat insulation is desirable.

For sealing of the window, sealing strips 51, 52 in the form of elastic sealing material may be inserted along one of the frame members. These sealing strips 51, 52 will preferably be placed against the frame member 1, which is positioned outdoors.

When assembled, the two frame members 1 are in locking engagement with one another. To obtain that configuration, a tubular portion 5 is positioned on the frame member 1, the tubular portion taking of a substantially cylindrical shape.

Typically, a large number of cylindrical portions are present, as shown in FIG. 1, but the following description is given as if only one single cylindrical portion is present.

Figure 8:
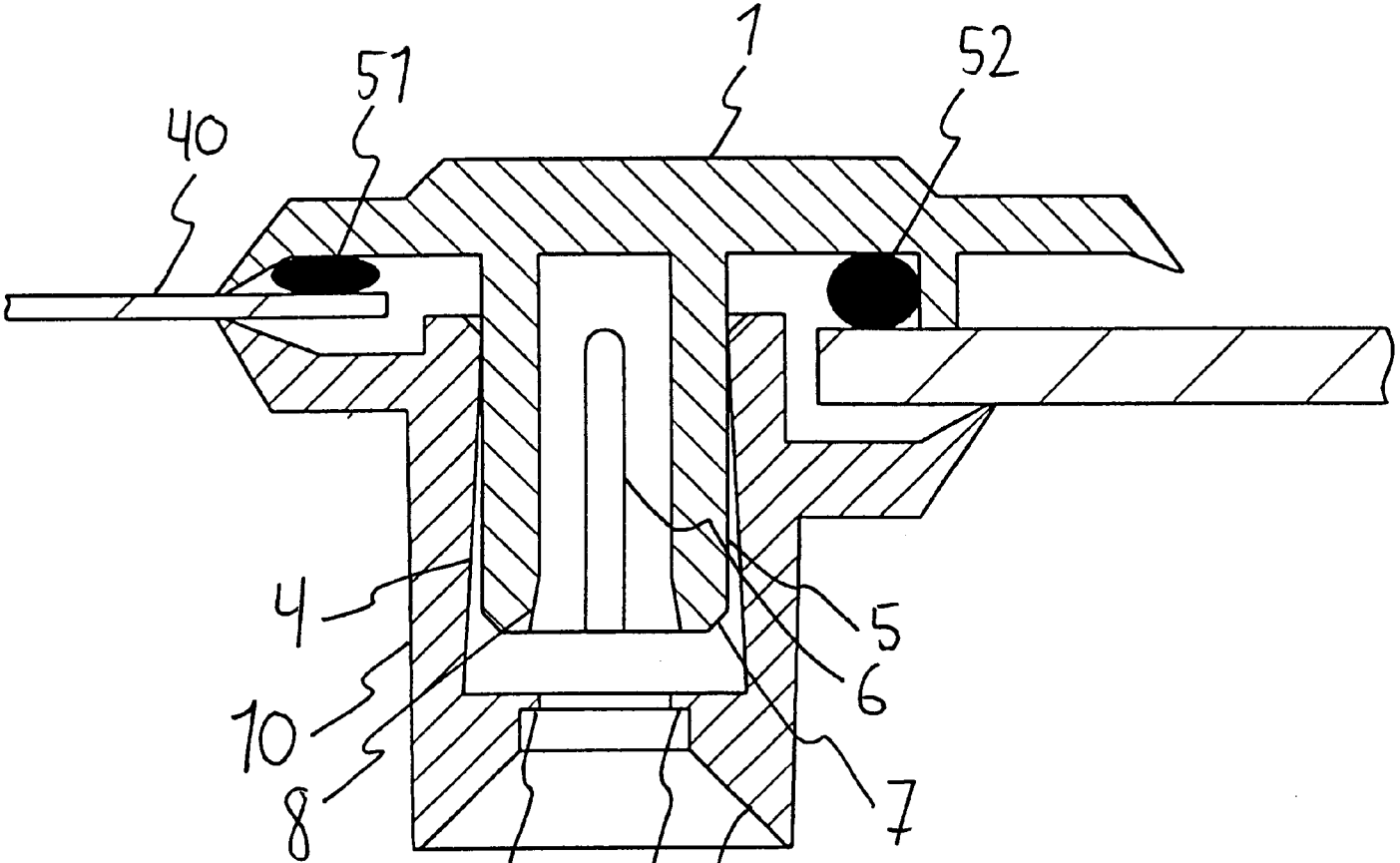
FIG. 8 shows a sectional view corresponding to FIG. 3 but without inserted mounting screw.

As shown in FIG. 8 the cylindrical, tubular portion has a cross section which is constant lengthwise, and a height which is smaller than the height of the raised members 30. The tubular portion 5 is provided with longitudinal slits 6 and a tapering 7 at the free end. The tape ring 7 may in principle extend over the major part of the height of the cylinder viz. such that the cylinder in practice is almost a conical form. However, it is important that its shape does not affect the desired effect of the cylinder as described in the following. Moreover, the interior cavity of the cylinder may have an area 8 with increased cross-section at the mouth. This increased cross sectional area facilitates the positioning and the driving in of a screw 3.In the embodiments shown, the number of slits is two, of which only one is shown FIGS. 3–8. There may be more than two, especially, in the case of a polygonal cross section of the tube where the number advantageously corresponds to the number of sides of the polygon, with the slits thus suitably positioned at the coners of the polygon.

The tubular portion 5 is shown with the frame assembled in a cavity 4 in the second frame 2. In the embodiment shown, the cavity 4 has the shape of an undercut truncated cone. Preferably, the mathematical generating line of the truncated cone forms an acute angle of approx. 1° with the axis of rotation of the truncated cone. For illustrative reasons the angle is, however, magnified in the figures.

In another embodiment, not shown, the cavity has the shape 4 of an undercut frustum of a pyramid. It should be noted that the base of the frustum of the pyramid is not necessarily quadratic, but may have any other polygonal form, such as a triangular, hexagonal, octagonal or rectangular form.

To ensure the locking engagement between the two frame members 1, 2, a screw is, when the frame is in its assembled condition, driven through the second frame member 2 into the tubular portion 5. The tubular portion is thereby expanded on account of the fact that the cylinder segments between the slits 6 are bent outwards. Compare for instance FIGS. 8 and 3.

When the cylinder segments are bent outwards in this manner, a locking form is in principle obtained. This happens when the cross sectional area of the expanded, tubular body exceeds the cross sectional area of the opening, through which it is inserted in the cavity 4 having the form of a truncated cone. In practice, certain reservations should be made, however, with respect to deformability of the materials, from which the frame members are made.

Irrespective of the fact that, in the drawing, a gap is shown between the cylinder, segments and the wail of the truncated cone, the geometry will preferably be chosen such that the cylinder segments are bent so far outwards that they abut the wall of the truncated cone and constitute a form substantially, complementary to the form of the truncated cone. Thus it is ensured that, in addition to the highest possible degree of form locking between the geometries, the highest possible friction is obtained between the outwards bent segments and the wall of the truncated cone, which further contributes to the locking.

Tests have shown that the friction and the form locking in itself is sufficient for holding the two frame members 1, 2 together. This means that the abutment 9 of the screw head on the second frame member 2, contrary to the case found in the prior art, is of no importance for the locking step. These tests have further shown that the screw 3 may be driven in straight away without rotation, i.e. it may, for instance, be pressed or rammed in.

The screw might possibly ruin the interior surface of the tubular portion 5. The pressing step may fray the comparatively soft plastic material. It is possible that the screw may cut a thread when removed during a subsequent separation of the frame.

This is, however, of little practical importance, as this will not be a process which is to be repeated very often. Typically, the screw will be driven in at the primary mounting in a factory and then never be removed again.

It should, however, be mentioned in this connection that the above-mentioned problem of ruining the interior surface of tubular section 5 may be prevented by using a screw which has no sharp thread. The screw only has to keep itself in place on the interior of the tubular portion.

As mentioned above, it is possible to unscrew the screws 3 in order, for instance, to replace a defective window pane 50. Although this will very seldom be necessary, it should, however, be possible according to the invention. With a view to this, only a suitable screwdriver is needed for removing the screws 3, after which the frame may be disassembled and a new window pane inserted. Then the frame may be reassembled merely by pressing the screws 3 in with a hard instrument, hitting them with a hammer, or screwing them in anew with the screwdriver.

It is on account of the use of common screws 3, which are visible, that it is intuitively obvious for the end user to understand, how the frame is to be disassembled, irrespective of whether the screws 3 originally were driven in without rotation at the factory.

To facilitate the automated mounting process at the factory, in the case of mounting a frame to a garage door, fastening means 10 for the screw 3 may be positioned in the base of the undercut truncated cone 4. The fastening means may be a thin membrane, which is penetrated by the screw 3 in connection with the premounting of the screws. The membrane may also, as shown in FIG. 8, be broken in advance, i.e. be provided with an opening having slightly smaller diameter than the screws.

While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein and defined in the claims.

What is claimed is:

1. A window frame having a first frame member and a second frame member for securing there between a window pane and having locking means for mutual locking engagement of the first and the second frame members, wherein said locking means comprises at least one expandable tubular portion formed on said first frame member and comprising at least one slit, at least one cavity in said second frame member, said cavity having an opening for insertion of said at least one tubular portion, and an at least one expansion member for insertion through said second frame member into said at least one tubular portion thereby expanding said at least one tubular portion into locking engagement with said at least one cavity.

2. A window frame according to claim 1, wherein the shape and the cross-sectional area of the opening of the cavity correspond to the cross-section of the tubular portion.

3. A window frame according to claim 1, wherein the expansion member expands the tubular portion to a form substantially complementary to the cavity.

4. A window frame according to claim 1 wherein the cavity is undercut as a truncated cone.

5. A window frame according to claim 4, wherein a mathematical generatrix of the truncated cone forms an acute angle with an axis of rotation of the truncated cone.

6. A window frame according to claim 5, wherein the mathematical generatrix of the truncated cone forms an acute angle of approximately 1° with the axis of rotation.

7. A window frame according to claim 1, wherein the cavity is undercut as a frustum of a pyramid having a base.

8. A window frame according to claim 7, wherein the edges of the frustum of the pyramid form an acute angle with the base.

9. A window frame according to claim 8, wherein the edges of the frustum of the pyramid each form an acute angle of approximately 89° with the base.

10. A window frame according to claim 1, wherein the expansion member is a screw.

11. A window frame according to claim 10, wherein the tubular portion is adapted to allow insertion of the screw without rotation thereof.

12. A window frame according to claim 10, wherein a bottom of the cavity positioned opposite the opening is provided with means for retaining the screw.

13. A window frame according to claim 12, wherein the means for retaining the screw comprises a thin membrane.

14. A window frame according to claim 1, wherein each of the two frame members is provided with tubular portions or cavities, respectively.

* * * * *